US007377490B1

(12) United States Patent
Khosravian

(10) Patent No.: US 7,377,490 B1
(45) Date of Patent: May 27, 2008

(54) MODULAR FENCE ASSEMBLY

(76) Inventor: Bahman Khosravian, 8839 Mourning Dove Ct., Gaithersburg, MD (US) 20879

( * ) Notice: Subject to any disclaimer, the term of this patent is extended or adjusted under 35 U.S.C. 154(b) by 73 days.

(21) Appl. No.: 11/188,054

(22) Filed: Jul. 25, 2005

Related U.S. Application Data

(60) Provisional application No. 60/613,358, filed on Sep. 27, 2004.

(51) Int. Cl.
*E06B 9/08* (2006.01)
*F04H 17/16* (2006.01)

(52) U.S. Cl. ..... 256/24; 256/23; 119/416; 160/24

(58) Field of Classification Search ..... 256/1, 256/24, 23, 37, 65.03, 73; 160/24; 119/416; 49/9, 65; 292/146, 150, 163, 175, 252; 211/180
See application file for complete search history.

(56) References Cited

U.S. PATENT DOCUMENTS 193,573 A * 7/1877 Tripp ..... 160/25
376,436 A * 1/1888 Harrison ..... 160/24
832,335 A * 10/1906 McDonald ..... 160/264
1,216,794 A * 2/1917 Garman ..... 160/31
1,299,986 A * 4/1919 Mattison
1,300,972 A * 4/1919 Janssen ..... 473/493
1,349,438 A * 8/1920 Samplawski ..... 292/175
1,526,126 A * 2/1925 Fitzherbert ..... 473/493
1,843,053 A * 1/1932 Voll et al. ..... 160/328
3,187,761 A * 6/1965 De Maio ..... 160/24
3,220,464 A * 11/1965 Wise ..... 160/24
4,119,301 A * 10/1978 Payne ..... 256/41
4,124,196 A * 11/1978 Hipskind ..... 256/1
4,595,155 A * 6/1986 Gough ..... 242/395.1
5,029,819 A 7/1991 Kane
5,613,543 A * 3/1997 Walton ..... 160/265
5,636,679 A * 6/1997 Miller et al. ..... 160/23.1
5,660,144 A * 8/1997 Venti ..... 160/24
D384,420 S 9/1997 Irvin
5,690,317 A * 11/1997 Sandsborg ..... 256/1
5,702,143 A * 12/1997 Shimazaki ..... 160/24
5,875,597 A * 3/1999 Gingrich et al. ..... 160/24
6,012,504 A * 1/2000 Siegal ..... 160/24
6,089,302 A * 7/2000 Britt ..... 160/28
6,092,792 A 7/2000 Camara (Continued)

FOREIGN PATENT DOCUMENTS

DE 19900154 A1 * 7/1999

(Continued)

*Primary Examiner*—Daniel P. Stodola
*Assistant Examiner*—Ernesto Garcia

(57) ABSTRACT

A fence assembly includes anchor brackets mountable to a first support wall. An anchor post is conjoined to the anchor brackets, has opposed top and bottom ends and is formed from rigid and non-corrosive material. Couplings are conjoined to the anchor post, are detachable therefrom and positional along a length thereof. A cylindrical housing defines a cavity therein, is provided with a slot and is formed from rigid and non-corrosive material. A screen passes through the slot, is formed from transparent material and can be adapted along at least a 180 degree arcuate path when extended. A rectilinear auxiliary post is permanently attached to a distal screen end, travels along an entire length thereof and is situated to an exterior of the housing. Latching brackets are connected to the auxiliary post and are engageable to a second support wall.

9 Claims, 7 Drawing Sheets

U.S. PATENT DOCUMENTS

| | | | | |
|---|---|---|---|---|
| 6,142,701 | A | 11/2000 | Falcon | |
| 6,375,165 | B1 * | 4/2002 | Sherratt et al. | 256/24 |
| 6,435,250 | B1 * | 8/2002 | Pichik et al. | 160/24 |
| 6,575,435 | B1 | 6/2003 | Kotzen | |
| 6,688,480 | B1 * | 2/2004 | Denny | 211/180 |
| 6,733,204 | B1 | 5/2004 | Paniccia | |
| 6,776,398 | B1 * | 8/2004 | Tsai | 256/43 |
| 6,807,999 | B1 * | 10/2004 | Bowen et al. | 160/24 |
| 6,969,185 | B1 * | 11/2005 | Adair | 49/9 |
| 7,082,981 | B2 * | 8/2006 | Perez, Jr. | 160/24 |

FOREIGN PATENT DOCUMENTS

| | | | |
|---|---|---|---|
| DE | 19950978 | A1 * | 4/2001 |
| GB | 2355751 | A * | 5/2001 |
| WO | WO 9423153 | A1 * | 10/1994 |

* cited by examiner

MODULAR FENCE ASSEMBLY

CROSS REFERENCE TO RELATED APPLICATIONS

This application claims the benefit of provisional application No. 60/613,358, filed on Sep. 27, 2004.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to fences and, more particularly, to a modular fence assembly for providing an adjustable barrier.

2. Prior Art

The use of adjustable barriers is known in the prior art. More specifically, child adjustable barriers heretofore devised and utilized are known to consist basically of familiar, expected and obvious structural configurations, notwithstanding the myriad of designs encompassed by the crowded prior art which have been developed for the fulfillment of countless objectives and requirements.

Conventionally, barricades of flexible sheet material, such as brattice cloth or other open plastics fabric is supported by so-called star posts driven in to the ground or roadway. Such posts are difficult to handle and to remove, and cause considerable damage upon removal, particularly where they have been driven in to asphalt or other roadway surfacing.

In an outdoor environment, the use of adjustable barriers is desirable to prevent wind blown dirt, sand, and other debris from contacting the user thereof or otherwise being deposited upon the user. Additionally, such barriers may desirably provide a degree of privacy to a user or group of users. One prior art adjustable barrier shows large fixed screens in the form of walls or fences. While such fixed screens are effective in providing protection against the wind and blowing objects, they are of course expensive, stationary structures which are impossible to transport. As a result, for those who find themselves outdoors on windy days either move to the shelter of a fixed wind fence or else suffer the discomfort and inconvenience of wind and blowing dirt and sand.

Accordingly, a need remains for a modular fence assembly in order to overcome the above-noted shortcomings. The present invention satisfies such a need by providing a fence assembly that is easy to use, versatile in application, and convenient. Instead of being frustrated with the inability to cordon off children or pets within a certain area, the modular fence assembly can be utilized. Such a fence assembly allows a room, business or other space to be quickly separated or sectioned off without having to erect an actual wall. The modular fence assembly provides flexibility in the length, angle and elevation of a portable barrier, allowing the use thereof in a wide range of applications. Such a modular fence assembly is easy to install, conveniently reusable, and effective.

BRIEF SUMMARY OF THE INVENTION

In view of the foregoing background, it is therefore an object of the present invention to provide a modular fence assembly. These and other objects, features, and advantages of the invention are provided by a retractable fence assembly for providing an adjustable barrier.

The fence assembly includes a plurality of anchor brackets directly mountable to a first support wall. Such anchor brackets effectively maintain a fixed spatial relationship during operating conditions. Each anchor bracket preferably includes a female member that has a substantially U-shaped flange portion and a male member including a plurality of spring-actuated pins extending laterally and outwardly therefrom. Such pins are equidistantly spaced apart and are removably insertable into the apertures such that the male and female members effectively maintain a static relationship during operating conditions.

An elongated and rectilinear anchor post is directly conjoined to the anchor brackets. Such an anchor post has axially opposed top and bottom end portions equidistantly spaced from the first support wall. The anchor post is formed from rigid and non-corrosive material.

A plurality of couplings are directly conjoined to selected portions of the anchor post. Such couplings are detachable from the anchor post and selectively positional along a longitudinal length of the anchor post.

A cylindrical housing has a longitudinal axis extending parallel to a longitudinal axis of the anchor post. Such a housing defines a cavity therein and is provided with a rectilinear slot extending parallel to the associated axis of the housing. The housing is formed from rigid and non-corrosive material. The anchor post and the housing may be provided with a notch formed at the top end portion thereof respectively such that additional anchor posts and the housings can advantageously be directly engaged with the anchor post and the housing as desired by the operator.

A screen is suitably sized and shaped for passing through the slot. Such a screen is formed from transparent material. The screen can be adapted along at least a 180 degree arcuate path when extended out of the housing An auxiliary post is directly attached to a distal end portion of the screen. Such an auxiliary post has a rectilinear shape and travels along an entire length of the distal end portion. The auxiliary post is permanently affixed to the screen and is situated to an exterior of the housing. Such an auxiliary post preferably includes a stub directly connected to a bottom surface thereof. Such a stub is formed from rubber material for advantageously and effectively maintaining sufficient frictional contact with a ground surface during operating conditions.

A plurality of latching brackets are directly connected to the auxiliary post. Such latching brackets are directly engageable to a second support wall for maintaining the screen at a tensed stated during operating conditions. Each latching bracket preferably includes a female member that has a substantially U-shaped flange portion and a male member including a plurality of spring-actuated pins extending laterally and outwardly therefrom. Such pins are equidistantly spaced apart and are removably insertable into the apertures such that the male and female members effectively maintain a static relationship during operating conditions.

In an alternate embodiment, the fence assembly may further include a plurality of rectilinear levers that have axially opposed end portions directly conjoined to selected ones of the anchor brackets and the housing respectively. Such levers are adjustably pivotal between lowered and raised positions for advantageously and effectively allowing the operator to position the housing and the screen on a first ground surface located subjacent a second ground surface on which the anchor post is supported.

In yet another embodiment, the fence assembly preferably further includes a plurality of reinforcement rods that have axially opposed end portions directly conjoined to selected ones of the anchor brackets in such a manner that the rods travel along a longitudinal length of the screen and effectively prevent a bystander from biasing the screen from a tensed position. Such rods travel substantially parallel to each other and are spaced medially of top and bottom edges of the screen.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
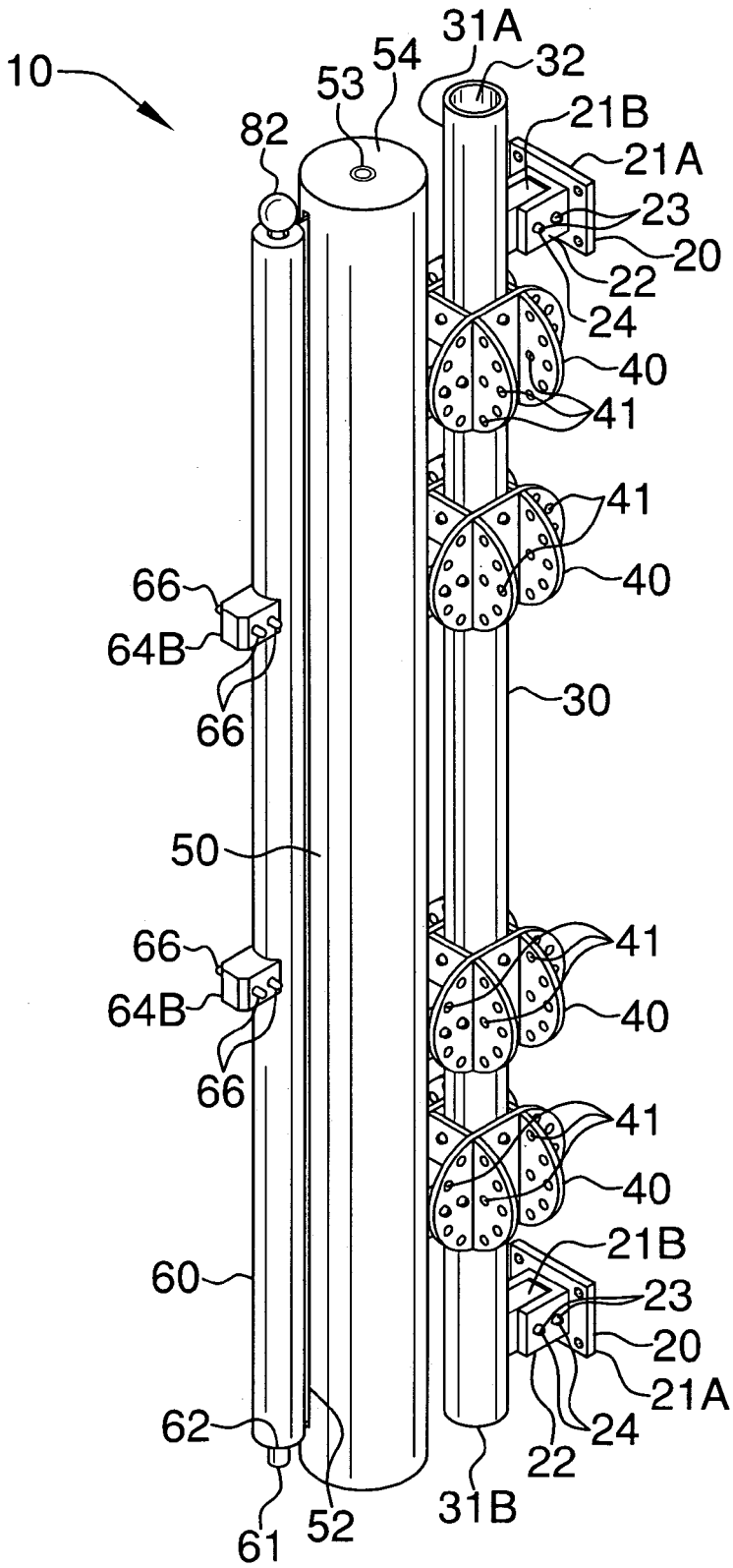
FIG. 1 is a perspective view showing a preferred embodiment of a modular fence assembly, in accordance with the present invention.
Figure 2:
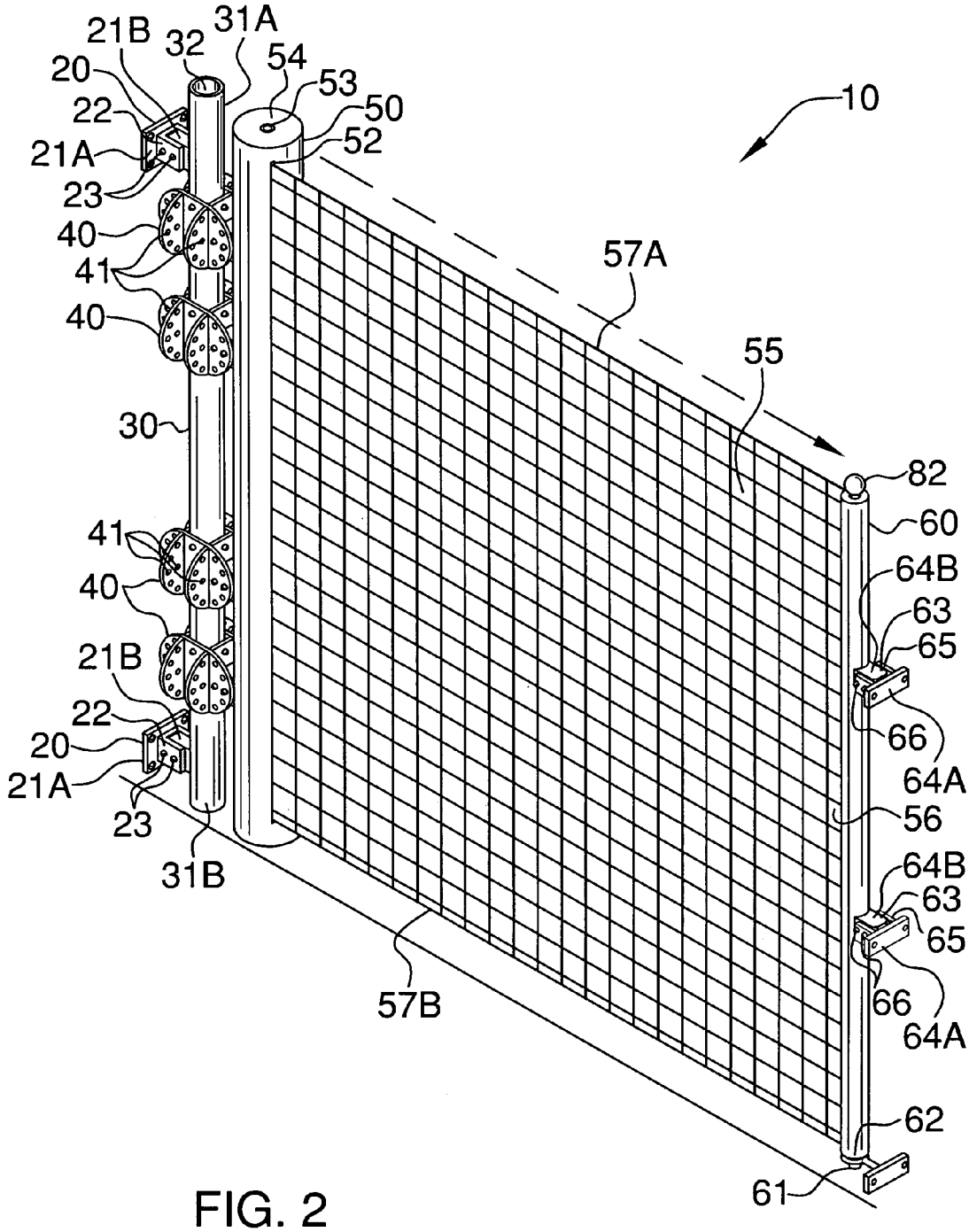
FIG. 2 is a perspective view of the assembly shown in FIG. 1, showing the screen at an extended position.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime number refer to alternate embodiments of such elements.

The assembly of this invention is referred to generally in FIGS. 1-8 by the reference numeral 10 and is intended to provide a modular fence assembly. It should be understood that the assembly 10 may be used to provide a barrier in many different situations and should not be limited in use to only cordoning children away from dangerous areas.

Referring initially to FIG. 1, the assembly 10 includes a plurality of anchor brackets 20 directly mountable to a first support wall 11 for statically orienting the assembly 10. Such anchor brackets 20 effectively maintain a fixed spatial relationship during operating conditions. Each anchor bracket 20 includes a female member 21A that has a substantially U-shaped flange portion 22 and a male member 21B including a plurality of spring-actuated pins 23 extending laterally and outwardly therefrom. Such a flange portion 22 also includes a plurality of apertures 24 formed therein. The pins 23 are equidistantly spaced apart and are removably insertable into the apertures 24 such that the male 21B and female 21A members effectively maintain a static relationship during operating conditions, which is essential and advantageous for ensuring and maintaining the stability of the assembly 10. The pins 23 further allow the male member 21B to be quickly and easily removed from the female member 21A thus, reducing the amount of time needed to collapse the assembly 10 after use thereof is no longer required.

Referring to FIGS. 1 through 8, an elongated and rectilinear anchor post 30 is directly conjoined, with no intervening elements, to the anchor brackets 20. Such an anchor post 30 has axially opposed top 31A and bottom 31B end portions equidistantly spaced from the first support wall 11. The anchor post 30 is formed from rigid and non-corrosive material, which is critical to ensure that the assembly 10 can withstand the forces exerted thereon during operating conditions, such as the wind and people pushing thereagainst.

Referring to FIGS. 1 through 6, a plurality of couplings 40 are directly conjoined, with no intervening elements, to selected portions of the anchor post 30. Such couplings 40 are detachable from the anchor post 30 and selectively positional along a longitudinal length of the anchor post 30. The couplings 40 further include a plurality of apertures 41 formed therein that are crucial for receiving the pins 23 therethrough in order to maintain the housing 50 (described herein below) statically connected to the anchor post 30.

Figure 3:
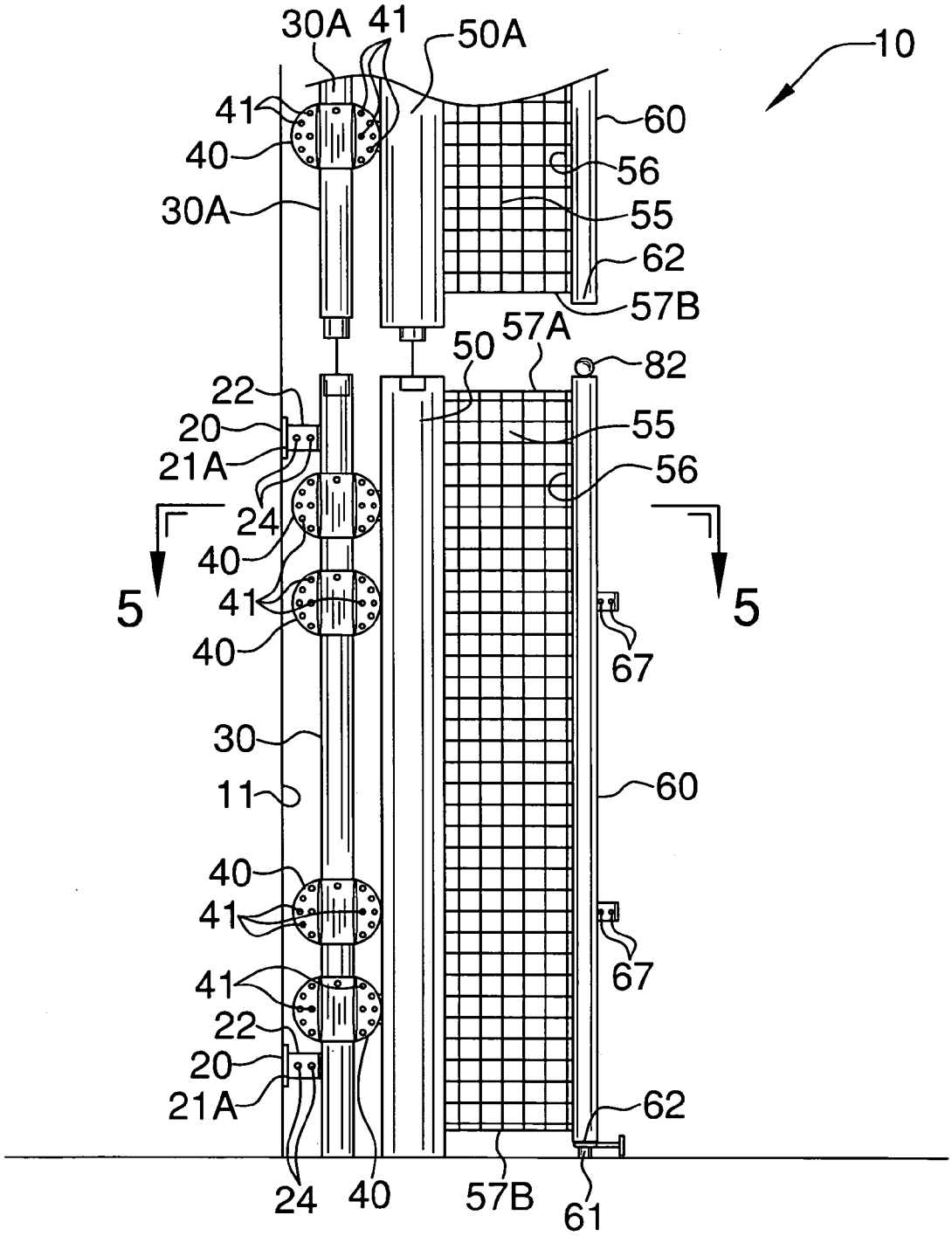
FIG. 3 is a side elevational view of the assembly shown in FIG. 1, showing one assembly being positional upon another assembly in order to alternate the amount of cover provided by the screens.
Figure 4:
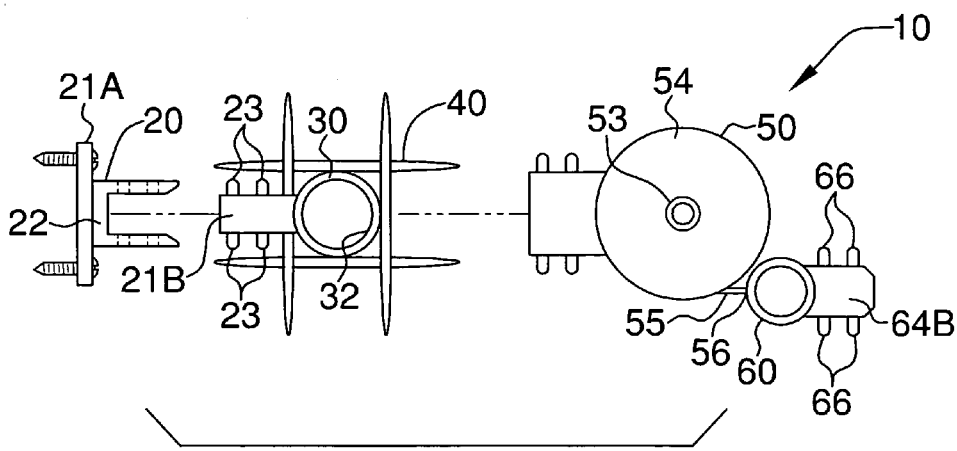
FIG. 4 is an exploded top plan view of the assembly shown in FIG. 1.
Figure 5:
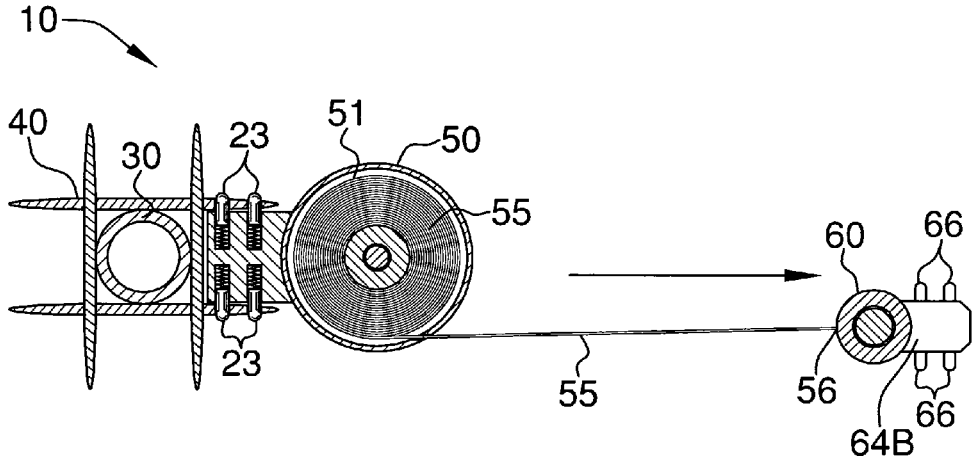
FIG. 5 is a cross-sectional view of the assembly shown in FIG. 3, taken along line 5-5.
Figure 6:
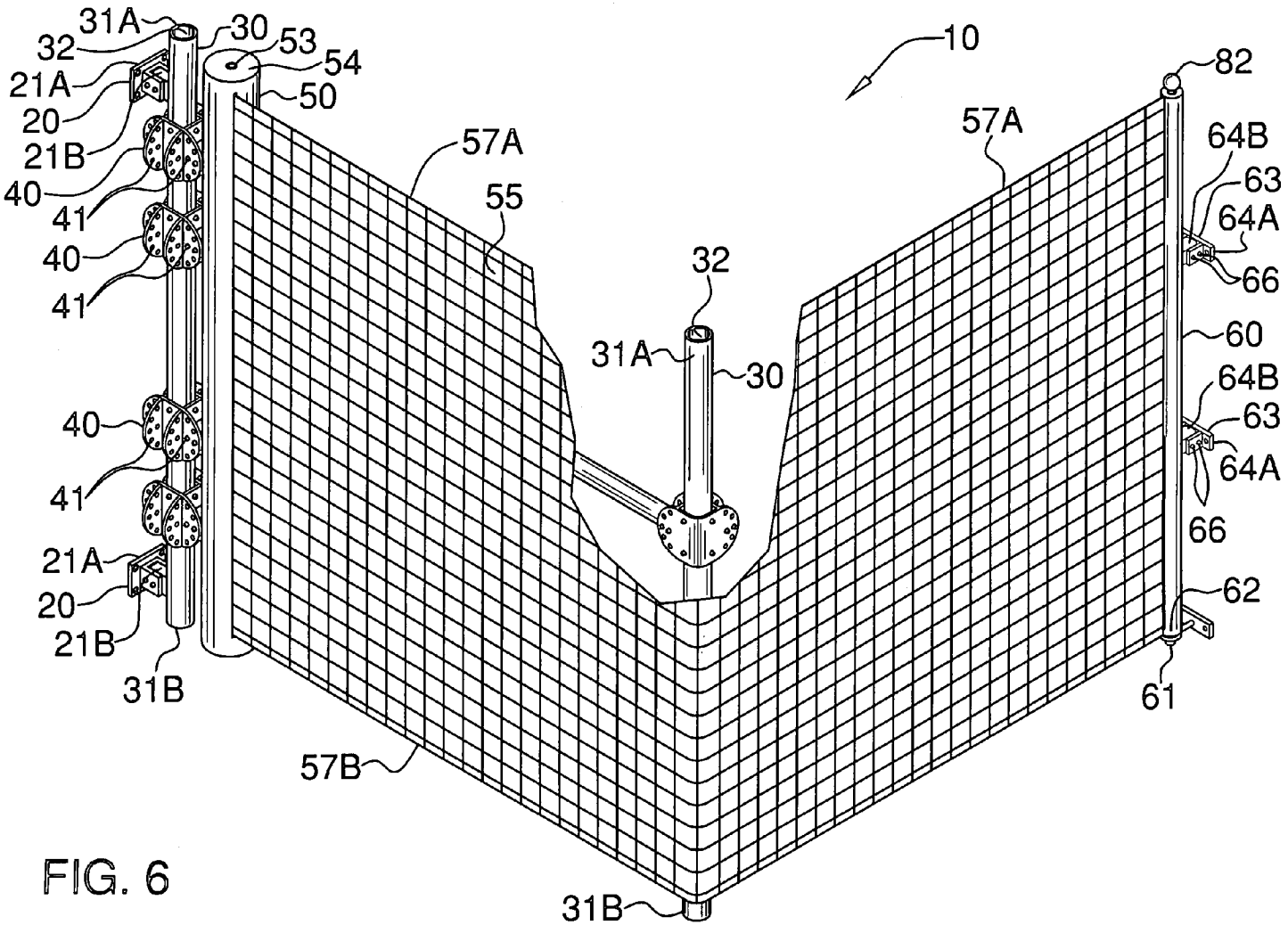
FIG. 6 is a perspective view of the assembly shown in FIG. 1, showing the adaptable nature of the screen.

Referring to FIGS. 1 through 8, a cylindrical housing 50 has a longitudinal axis extending parallel to a longitudinal axis of the anchor post 30. Such a housing 50 defines a cavity 51 therein and is provided with a rectilinear slot 52 extending parallel to the associated axis of the housing 50. The housing 50 is formed from rigid and non-corrosive material, which is vital to ensure that the assembly 10 can withstand the forces exerted thereon during operating conditions, such as the wind and people pushing thereagainst. The anchor post 30 and the housing 50 are provided with a notch 32, 53 formed at the top end portion 31A, 54 thereof respectively such that additional anchor posts 30A and the housings 50A can advantageously be directly engaged, with no intervening elements, with the anchor post 30 and the housing 50 as desired by the operator, as is best shown in FIG. 3.

Referring to FIGS. 2, 3 and 5 through 8, a screen 55 is suitably sized and shaped for passing through the slot 52. Such a screen 55 is formed from transparent material. Of course, the screen 55 may be produced from a variety of alternate materials depending on the intended application thereof, as is obvious to a person of ordinary skill in the art. The screen 55 can be adapted along at least a 180 degree arcuate path when extended out of the housing 50

Referring to FIGS. 1 through 8, an auxiliary post 60 is directly attached, with no intervening elements, to a distal end portion 56 of the screen 55. Such an auxiliary post 60 has a rectilinear shape and travels along an entire length of the distal end portion 56. The auxiliary post 60 is permanently affixed to the screen 55 and is situated to an exterior of the housing 50. Such an auxiliary post 60 includes a stub 61 directly connected, with no intervening elements, to a bottom surface 62 thereof. Such a stub 61 is formed from rubber material, which is important for advantageously and effectively maintaining sufficient frictional contact with a ground surface during operating conditions.

Referring to FIGS. 1, 2, 3, 6 and 7, a plurality of latching brackets 63 are directly connected, with no intervening elements, to the auxiliary post 60. Such latching brackets 63 are directly engageable, with no intervening elements, to a second support wall (not shown) for effectively maintaining the screen 55 at a tensed stated during operating conditions. Thus, a user can quickly and conveniently form a privacy barrier within a room or between two adjacent rooms with no previous wall. Each latching bracket 63 includes a female member 64A that has a substantially U-shaped flange portion 65 and a male member 64B including a plurality of spring-actuated pins 66 extending laterally and outwardly therefrom. Such a flange portion 65 also includes a plurality of apertures 67 formed therein. Such pins 66 are equidistantly spaced apart and are removably insertable into the apertures 67 such that the male 64B and female 64A members effectively maintain a static relationship during operating conditions, which is essential and advantageous for ensuring and maintaining the stability of the assembly 10. The pins 66 further allow the male member 64B to be quickly and easily removed from the female member 64A thus reducing the amount of time needed to collapse the assembly 10 after use thereof is no longer required.

Figure 7:
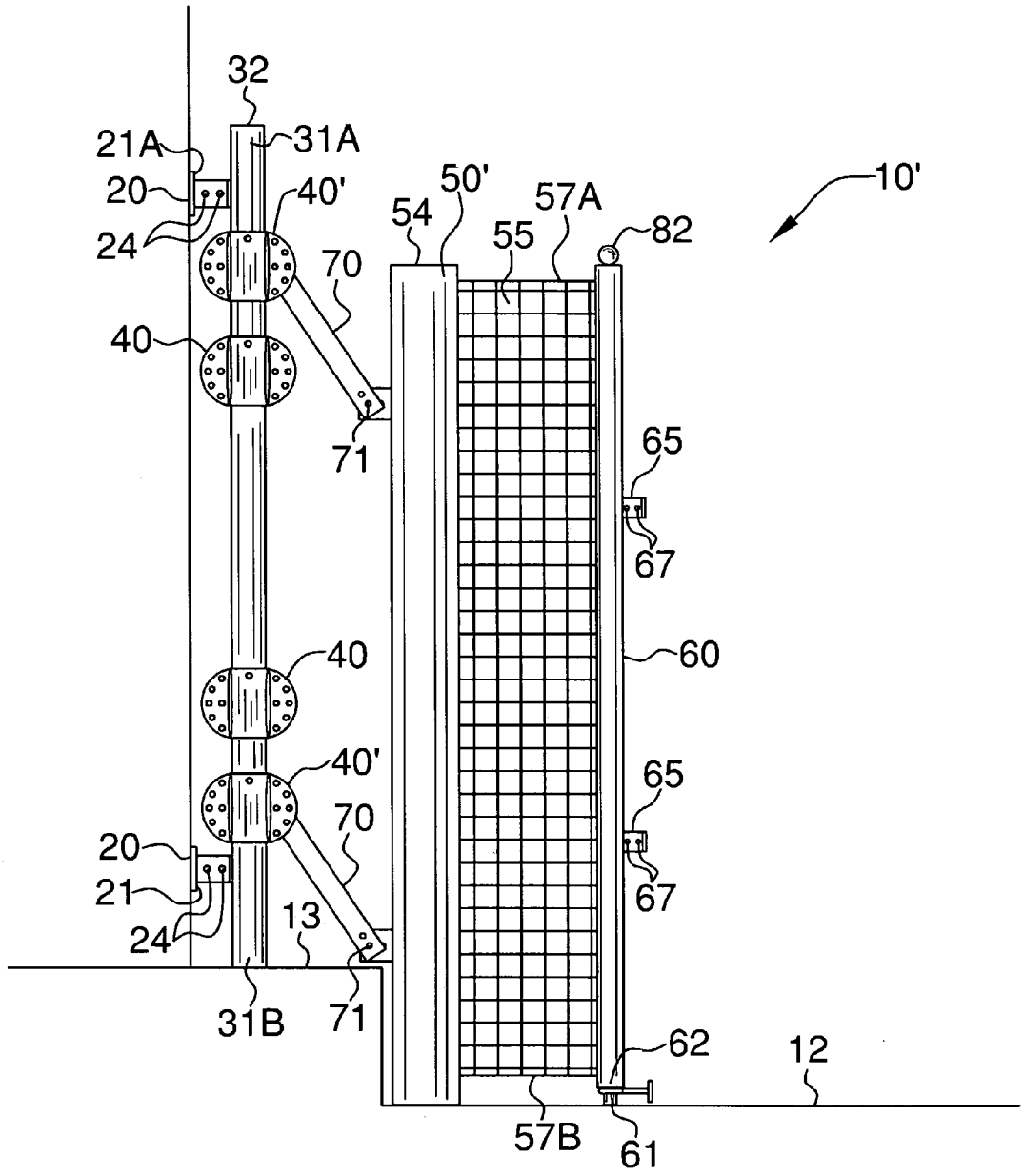
FIG. 7 is a side-elevational showing an alternate embodiment of the assembly shown in FIG. 1.

Referring to FIG. 7, in an alternate embodiment 10', the fence assembly 10' includes a plurality of rectilinear levers 70 that have axially opposed end portions 71 directly conjoined, with no intervening elements, to selected ones of the couplings 40' and the housing 50' respectively. Such levers 70 are adjustably pivotal between lowered and raised positions for advantageously and effectively allowing the operator to position the housing 50' and the screen 55 on a first ground surface 12 located subjacent a second ground surface 13 on which the anchor post 30' is supported.

Figure 8:
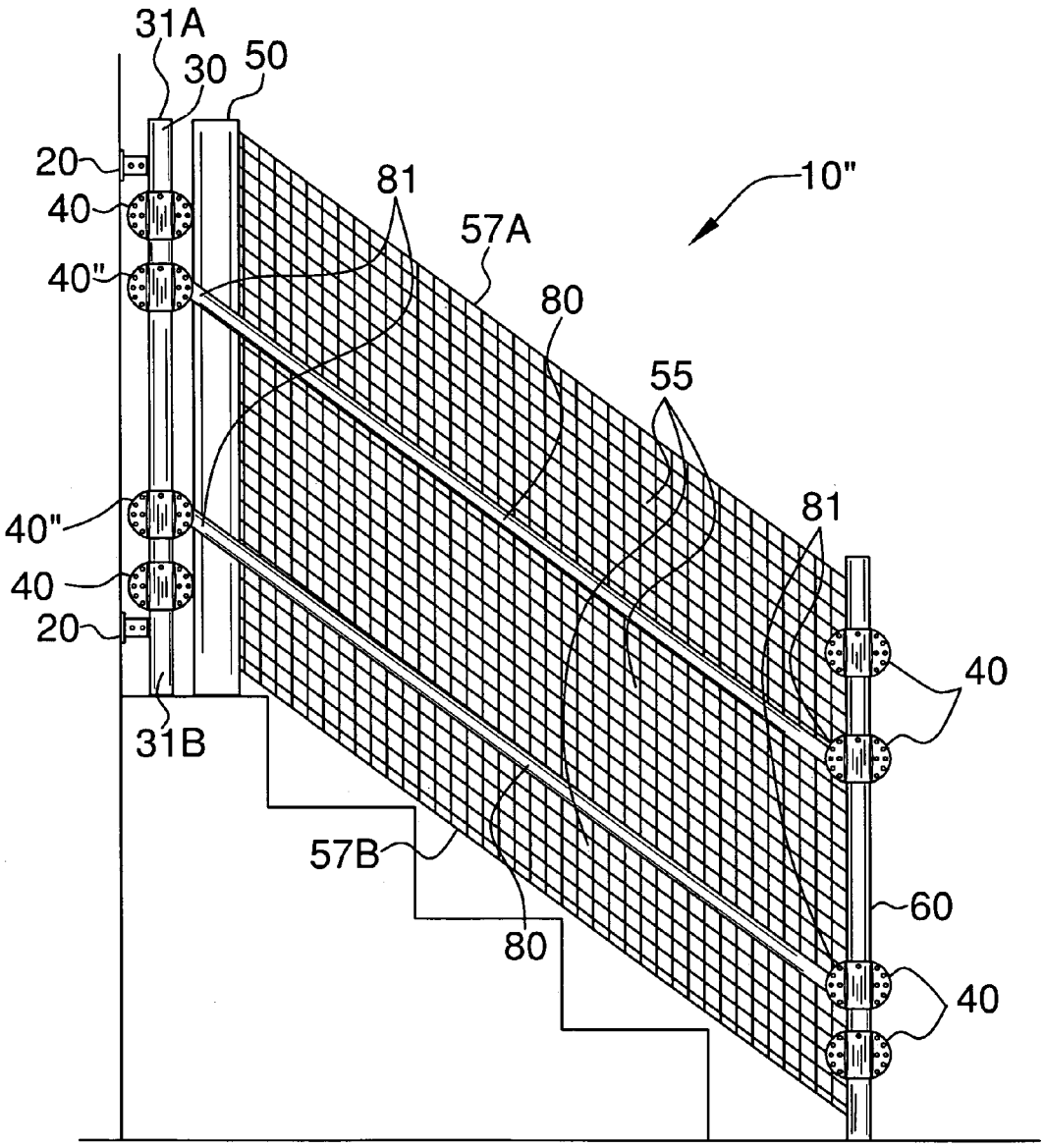
FIG. 8 is a side-elevational view showing a final embodiment of the assembly shown in FIG. 1.

Referring to FIG. 8, in yet another embodiment 10", the fence assembly 10" further includes a plurality of reinforcement rods 80 that have axially opposed end portions 81 directly conjoined, with no intervening elements, to selected ones of the couplings 40" in such a manner that the rods 80 travel along a longitudinal length of the screen 55 and effectively prevent a bystander from biasing the screen 55 from a tensed position. Such rods 80 travel substantially parallel to each other and are spaced medially of top 57A and bottom 57B edges of the screen 55.

Referring back to FIG. 1, an actuating ball 82 is seated directly onto a top end portion of the auxiliary post 60. Such an actuating ball 82 is operably connected to pins 66 in such a manner that pins 66 are releasable from an engaged position when an operator lifts the actuating ball 82 vertically up and away from the auxiliary post 60. It is noted the actuating ball 82 may employ conventional gears, belts, pulleys, levers and/or drives well known in the industry and may further be linked to pins 66 in a variety of conventional manners well known to a person of ordinary skill in the art. For example, a shaft may be cantilevered to a spring-actuated arm, which retracts pins 66 from an exposed position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A retractable fence assembly for providing an adjustable barrier, said fence assembly comprising:

a plurality of anchor brackets maintaining a fixed spatial relationship during operating conditions;

an elongated and rectilinear anchor post directly conjoined to said anchor brackets, said anchor post having axially opposed top and bottom end portions equidistantly spaced from a first support wall;

a plurality of couplings directly conjoined to selected portions of said anchor post, said couplings being detachable from said anchor post and selectively positional along a longitudinal length of said anchor post;

a cylindrical housing having a longitudinal axis extending parallel to a longitudinal axis of said anchor post, said housing defining a cavity therein and being provided with a rectilinear slot extending parallel to the longitudinal axis of said housing;

a screen suitably sized and shaped for passing through the slot;

an auxiliary post directly attached to a distal end portion of said screen, said auxiliary post having a rectilinear shape and traveling along an entire length of said distal end portion, wherein said auxiliary post is permanently affixed to said screen and is situated exterior of said housing; and a plurality of latching brackets directly connected to said auxiliary post, said latching brackets being directly engageable to a second support wall for maintaining said screen at a tensed stated during operating conditions;

wherein said screen can be adapted along at least a 180 degree arcuate path when extended out of said housing;

wherein each said anchor brackets and each said latching brackets comprises:

a female member having a substantially U-shaped flange portion, and a male member including a plurality of spring-actuated pins extending laterally and outwardly therefrom;

wherein said pins are removably insertable into said male and female members.

2. The fence assembly of claim 1, wherein said anchor post and said housing are provided with a notch formed at said top end portion thereof respectively such that additional ones of said anchor post and said housing can be directly engaged with said anchor post and said housing as desired by an operator.

3. The fence assembly of claim 1, wherein said auxiliary post further comprises:

a stub directly connected to a bottom surface thereof, said stub being formed from rubber material for maintaining sufficient frictional contact with a ground surface during operating conditions.

4. A retractable fence assembly for providing an adjustable barrier, said fence assembly comprising:

a plurality of anchor brackets maintaining a fixed spatial relationship during operating conditions;

an elongated and rectilinear anchor post directly conjoined to said anchor brackets, said anchor post having axially opposed top and bottom end portions equidistantly spaced from a first support wall;

a plurality of couplings directly conjoined to selected portions of said anchor post, said couplings being detachable from said anchor post and selectively positional along a longitudinal length of said anchor post;

a cylindrical housing having a longitudinal axis extending parallel to a longitudinal axis of said anchor post, said housing defining a cavity therein and being provided with a rectilinear slot extending parallel to the longitudinal axis of said housing;

a screen suitably sized and shaped for passing through the slot, said screen being formed from transparent material;

an auxiliary post directly attached to a distal end portion of said screen, said auxiliary post having a rectilinear shape and traveling along an entire length of said distal end portion, wherein said auxiliary post is permanently affixed to said screen and is situated exterior of said housing; and a plurality of latching brackets directly connected to said auxiliary post, said latching brackets being directly engageable to a second support wall for maintaining said screen at a tensed stated during operating conditions;

wherein said screen can be adapted along at least a 180 degree arcuate path when extended out of said housing;

wherein each said anchor brackets and each said latching brackets comprises:

a female member having a substantially U-shaped flange portions, and a male member including a plurality of spring-actuated pins extending laterally and outwardly therefrom;

wherein said pins are removably insertable into said male and female members.

5. The fence assembly of claim 4, wherein said anchor post and said housing are provided with a notch formed at said top end portion thereof respectively such that additional ones of said anchor post and said housing can be directly engaged with said anchor post and said housing as desired by an operator.

6. The fence assembly of claim 4, wherein said auxiliary post further comprises:

a stub directly connected to a bottom surface thereof, said stub being formed from rubber material for maintaining sufficient frictional contact with a ground surface during operating conditions.

7. A retractable fence assembly for providing an adjustable barrier, said fence assembly comprising:

a plurality of anchor brackets maintaining a fixed spatial relationship during operating conditions;

an elongated and rectilinear anchor post directly conjoined to said anchor brackets, said anchor post having axially opposed top and bottom end portions equidistantly spaced from a first support wall, said anchor post being formed from rigid and non-corrosive material;

a plurality of couplings directly conjoined to selected portions of said anchor post, said couplings being detachable from said anchor post and selectively positional along a longitudinal length of said anchor post;

a cylindrical housing having a longitudinal axis extending parallel to a longitudinal axis of said anchor post, said housing defining a cavity therein and being provided with a rectilinear slot extending parallel to the longitudinal axis of said housing, said housing being formed from rigid and non-corrosive material;

a screen suitably sized and shaped for passing through the slot, said screen being formed from transparent material, an auxiliary post directly attached to a distal end portion of said screen, said auxiliary post having a rectilinear shape and traveling along an entire length of said distal end portion, wherein said auxiliary post is permanently affixed to said screen and is situated exterior of said housing; and a plurality of latching brackets directly connected to said auxiliary post, said latching brackets being directly engageable to a second support wall for maintaining said screen at a tensed stated during operating conditions;

wherein said screen can be adapted along at least a 180 degree arcuate path when extended out of said housing;

wherein each said anchor brackets and each said latching brackets comprises:

a female member having a substantially U-shaped flange portion, and a male member including a plurality of spring-actuated pins extending laterally and outwardly therefrom;

wherein said pins are removably insertable into said male and female members.

8. The fence assembly of claim 7, wherein said anchor post and said housing are provided with a notch formed at said top end portion thereof respectively such that additional ones of said anchor post and said housing can be directly engaged with said anchor post and said housing as desired by an operator.

9. The fence assembly of claim 7, wherein said auxiliary post further comprises:

a stub directly connected to a bottom surface thereof, said stub being formed from rubber material for maintaining sufficient frictional contact with a ground surface during operating conditions.

* * * * *